United States Patent [19]

Rutshtein et al.

[11] 3,951,586

[45] Apr. 20, 1976

[54] METHOD OF OPERATING THE HEATING STOVES

[75] Inventors: Alexander Rutshtein; Naum Staroselsky, both of West Des Moines, Iowa

[73] Assignee: Compressor Controls Corporation, Des Moines, Iowa

[22] Filed: Jan. 9, 1975

[21] Appl. No.: 539,710

[52] U.S. Cl. ..... 432/30; 432/40; 432/219

[51] Int. Cl.[2] ..... F24H 7/00

[58] Field of Search ..... 432/40, 39, 219, 221, 432/30; 266/14; 75/42

[56] References Cited

UNITED STATES PATENTS 3,159,385 12/1964 Flanagan ..... 432/40

3,738,795 6/1973 Hever ..... 266/14

*Primary Examiner*—John J. Camby

*Attorney, Agent, or Firm*—Henderson, Strom & Sturm

[57] ABSTRACT

A method is disclosed for the improved operation of heating stoves for blast furnaces. This method is comprised of a combined use of an independent source of compressed air and potential and thermal energy of air remaining in the heating stoves at the end of a period of cooling. The purpose of this method is to reduce the time of filling of the ready to go on — wind stoves by compressed air; to stabilize the operating conditions of the blast furnace; to save coke; to save the fuel spent on heating the stoves.

2 Claims, 4 Drawing Figures

METHOD OF OPERATING THE HEATING STOVES

BACKGROUND OF THE INVENTION

1. Field of the Invention

The invention relates to the iron and steel industry, particularly to heating stoves of blast furnaces.

2. Prior Art

Each blast furnace is equipped with two or more heating stoves used for heating the blast before delivering it into a blast furnace. The conventional methods of operating such stoves are the alternative and the parallel (which here and below will mean staggered parallel, that is, parallel displaced in phase).

According to the first method, the alternative, at any given moment (not taking into consideration the short periods of connecting the ready to go on — wind stove to the hot air manifold) the blast is heated in only one stove, while at the same time all of the other stoves are in their periods of heating. In this first method the stoves are connected to the blast furnace alternatively, one after another, in some definite pre-established order.

A time, temperature and pressure diagram of the group of stoves working alternatively is shown in the FIG. 1. The lines $A_1$ $B_1$ $D_1$ $C_1$, $A_2$ $B_2$ $D_2$ $C_2$, and so on, show the changing temperature of the blast as a function of time after the corresponding stoves No. 1, No. 2 and so on.

As shown in FIG. 1, at the end of the period of cooling of stove No. 1 ($D_1$) stove No. 2 begins to be connected to the pipe of the cold blast ($A_2$). The duration of this period of connecting ($\Delta\tau_1$) is usually 4 to 6 minutes. The section $A_1$ $B_1$, $A_2$ $B_2$, and so on, show how the losses of heat to the surrounding medium during the periods of pressurization influences the initial temperature of the hot air ($T_1$).

The point $B_2$ corresponds to the moment of connecting the stove No. 2 to the hot blast manifold. Simultaneously the stove No. 1 is disconnected from both manifolds of cold and hot blast (point $C_1$) and after that, is connected to the atmosphere.

The line FF on FIG. 1 demonstrates the changing of the pressure of the blast air as a function of time. The diagram of FIG. 1 shows that during the periods of switching the stoves (sections $E_1$ $C_1$, $E_2$ $C_2$ and so on) the pressure of the blast drops. This drop of pressure is caused by the extraction of part of the air from the cold blast manifold to pressurize the stove being prepared to go on — wind.

Usually the drop of pressure, $\Delta\rho$, is 4 to 5 PSI. It is evident that during the periods of filling the stoves, the blast furnace receives less air than during other periods of time. These periodical drops in flow rate of the blast going to the furnace, which are accompanied by drops of pressure, adversely affect both the stability of operation and the efficiency of the blast furnace.

The optimal duration of the periods of switching is determined empirically by furnace engineers. Reducing this duration of the switching period would result in sharper drops of both the pressure of the blast air and the flow rate to the blast furnace, which is likely to cause serious disturbances to the blast furnace process. Increasing this duration would, on the other hand, result in increasing the thermal losses to the surrounding medium.

Under the staggered parallel operation of the stoves, as distinct from the above described method, at any given moment (except during the short term periods of pressurization) the blast air is heated in two stoves, which are operated in parallel, with displacement in phase approximately equal to half of the duration of the period of cooling of one stove.

A diagram illustrating this order of switching is shown in FIG. 2. Usually the period of time between two successive switchings of the stoves ($\tau_2$) under the staggered parallel operation is less than under the alternative operation ($\tau_1$), and the period of filling the stoves ($\Delta\tau_1$) is the same for both methods. Switching stoves under the staggered parallel operation has the same negative consequences which take place with the alternative method (see line DD, FIG. 2).

A number of methods are known for reducing or eliminating the drops of pressure during the periods of switching stoves. One particular method of fast pressurization of the stoves is by compressed air from an independent source, for example, an intermediate accumulator. This accumulator contains air compressed to a considerably higher pressure than the normal pressure of the blast air. The pressure in this accumulator is maintained by a special auxilliary compressor.

No one of the known methods solves the problem of using the compressed, still heated air, which is in some cases enriched by oxygen, that is still contained within the worked off and already cooled stove.

The energy of this air can be used differently depending on the method of operating of the stoves (alternative or staggered parallel). In the case of staggered parallel operation, the maximum effect will be from the method which combines the solution of the above mentioned problem with the use of an independent source of compressed air.

SUMMARY OF THE INVENTION

The present invention relates to an improved method of operating blast furnace heating stoves with staggered parallel operation. A first stove, which is already cooled, is successively connected first to a second stove, which is ready to go on — wind, thereby equalizing the air pressure between the first and second stoves and then the first stove is connected with a third stove, which is in the period of heating, therby using the heated air of the first stove for the burning of fuel in the third stove. After disconnection from the first stove, the second stove is then fully pressurized by compressed air from an independent source.

Under an improved alternative operation of heating stoves, all of the excess air from a stove which is being cooled is used for burning fuel in one of the stoves which are in a period of heating.

One object of the present invention is to reduce the amount of air needed to be compressed for pressurizing blast furnace stoves.

A further object of the present invention is to maintain as much as possible a constant flow of heated air to a blast furnace by eliminating drops of pressure and in such a way to increase the stability of operation, the efficiency and the output of a blast furnace.

Still another object of the present invention is to reduce the fuel needed for heating blast furnace stoves.

Other objects, advantages and novel features of the present invention will become apparent from the following detailed description of the invention when considered in conjunction with the accompanying drawings.

DETAILED DESCRIPTION OF THE INVENTION

Figure 1:
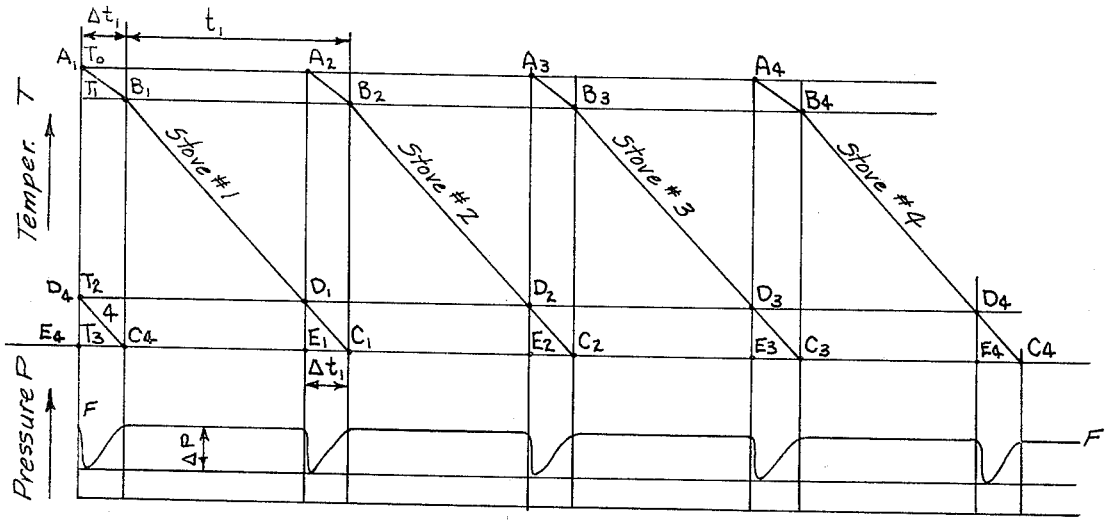
FIG. 1 is a graph which shows the approximate relationship of time to the blast air pressure and temperature, after stoves working under the customary alternative method.
Figure 2:
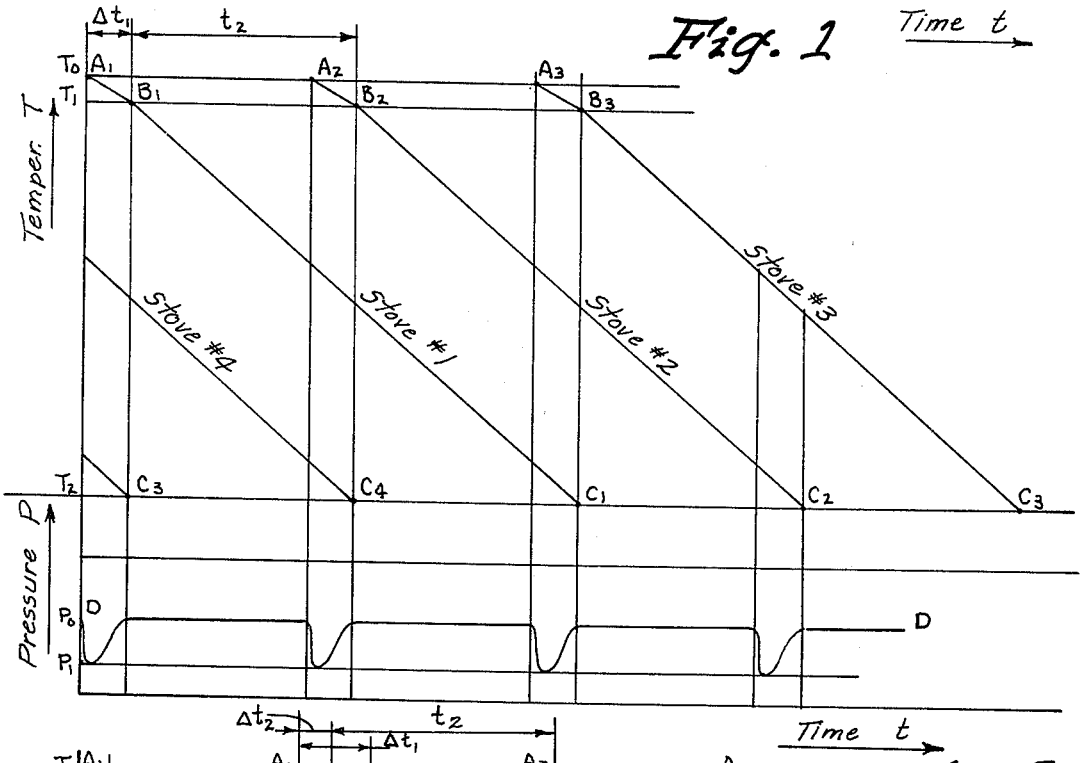
FIG. 2 is a graph which shows the approximate relationship of time to blast air pressure and temperature, after stoves working under the customary method of staggered parallel operation.
Figure 3:
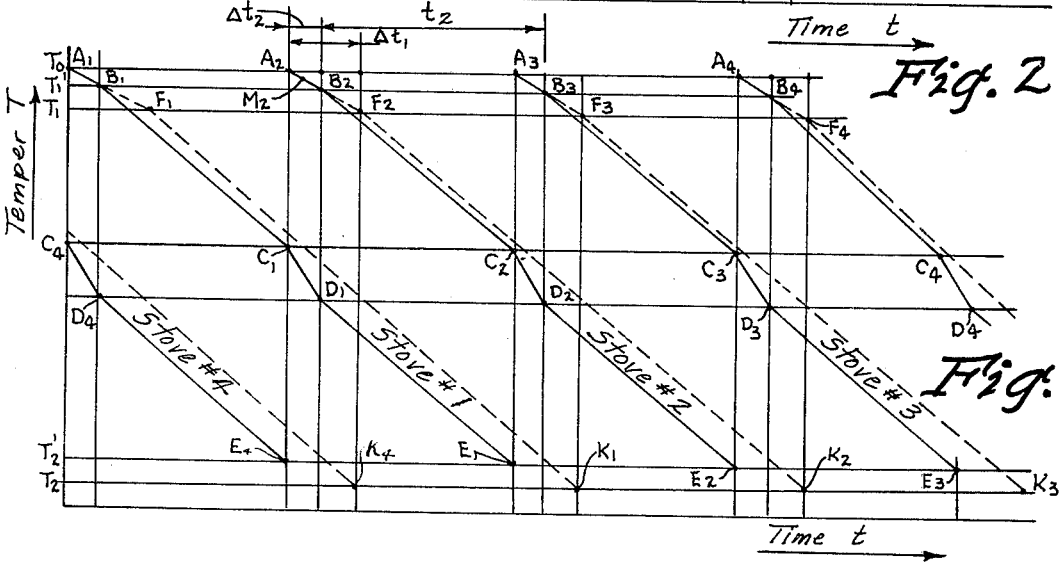
FIG. 3 is a graph which shows the approximate relationship of time to blast air temperature, after the stoves, working under the improved method of staggered parallel operation.

The diagram illustrating the improved method of the present invention is shown in FIG. 3. The stroke line $A_1$ $F_1$ $K_1$ is platted in FIG. 3 for compraison. This stoke line corresponds to the conventional operation under the staggered parallel method, shown in FIG. 2. The period $\Delta\tau_2$ corresponds to the time of filling the stove.

According to the improved method, the stove No. 1, cooled and disconnected from both hot and cold blast manifolds (FIG. 3), is first connected to the stove No. 2, which is ready to go on — wind and is not yet connected to both said manifolds (point $A_2$, FIG. 3). After equalizing the pressure in both stoves No. 1 and No. 2, stove No. 2 is disconnected from stove No. 1 and then is connected to an independent source of compressed air (point $M_2$). As a result, the pressure in the stove No. 2 increases up to the required level after which it is connected to both hot and cold blast manifolds (point $B_2$). After the disconnection from the stove No. 2, the stove No. 1, still containing some quantity of compressed and heated air, is connected to stove No. 3 which is in a period of heating. Thus the heat of the hot air from stove No. 1 is partly used for heating the stove No. 3.

The sections $C_1$ $D_1$, $C_2$ $D_2$ and so on, on the diagram, FIG. 3 correspond to the periods of filling the stoves, when all of the blast air passes through only one stove and correspondingly this one stove is cooling more intensively.

The temperature of the air $T_2^1$ at the end of the period of cooling of the stove, according to the improved method (points $E_1$, $E_2$ and so on, on FIG. 3), generally speaking, should be only little different from the temperature $T_2$ under the conventional method (points $C_1$, $C_2$, and so on, FIG. 2, and the point $K_1$ on FIG. 3). While keeping the same period of cooling of the stove, $\tau_2$, the temperature $T_2^1$(FIG. 3), can be a little higher or a little lower than the temperature $T_2$, depending on the ratio $\Delta\tau_2/\Delta\tau_1$ , or, said differently, depending on the reducing of the time achieved in filling the stoves.

Figure 4:
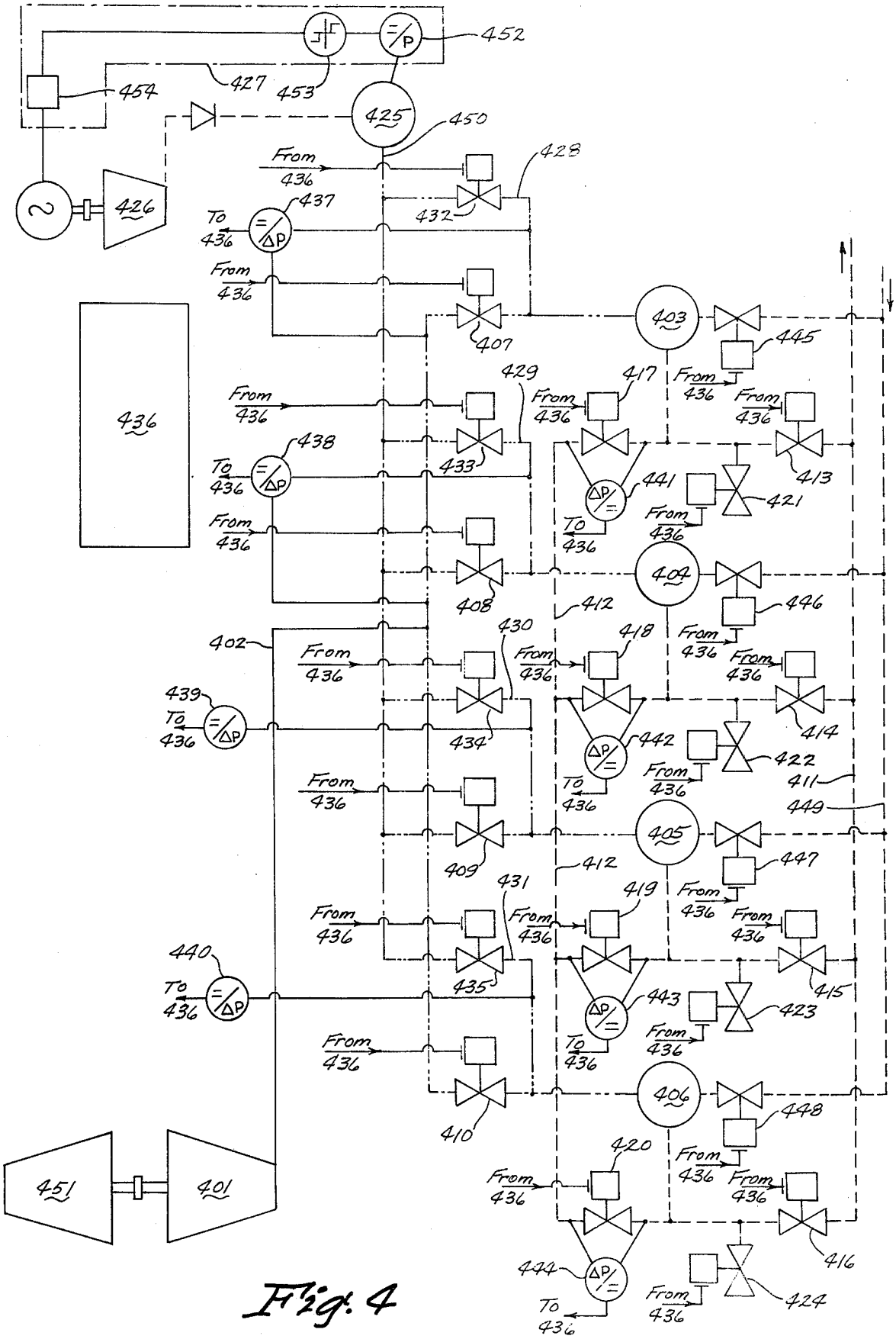
FIG. 4 is a diagram of the automatic system for pressurizing stoves according to the improved method.

Referring now to FIG. 4 a system is shown for practicing the present invention. The system includes generally a blast furnace turbo-blower, manifolds of hot and cold blast, heating stoves, pipes bringing the fuel to the stoves, an auxilliary compressor and an intermediate accumulator. Assume that the heating stoves are working according to the staggered parallel operation. It is to be understood that the system of FIG. 4 shows only those control and shut-off pipe fittings which are necessary for a clear description of the control system.

A turbocompressor 401 is shown having a turbine drive 451, equipped with a system for automatically maintaining the required mass flow rate of the blast. The turbocompressor 401 delivers the compressed air into the pipe 402 of the cold blast. This pipe or manifold 402 of cold blast connects the turbocompressor 401 with four heating stoves 403 to 406.

Stoves 403 to 406 are connected with the cold blast manifold 402 by means of cut-off valves 407 to 410, and with a hot blast manifold 411 by means of cut-off valves 413 to 416.

Each of the stoves 403 to 406 can also be connected either with any other stove by means of an auxiliary manifold 412 and throttling means 417 to 420, or with the atmosphere by means of discharge valves 421 to 424. In order to reduce the time of filling the stoves 403 to 406, the stoves are connected with the intermediate accumulator or compressed air tank 425 by means of a manifold 450, pipes 428 to 431 and cut-off valves 432 to 435.

The accumulator 425 is connected to an auxiliary compressor 426, equipped with a control system 427. System 427 is intended to start the compressor 426 when the pressure in the accumulator 425 drops to a certain definite magnitude, and to stop the compressor 426 when the pressure in the accumulator 425 reaches a certain definite level. The system 427 includes a transducer of pressure 452, a relay element 453 and a sub-system 454 for starting and stopping the compressor 426.

In order to heat the stoves, all of them are supplied with gaseous fuel by means of a pipeline 449, and also with air required for burning the fuel. The air pipes and the air blowers are not shown on this drawing. On the pipeline 449 bringing fuel to the stoves 403 to 406 there are installed throttling means 445 to 448.

The sequence of operations required for switching the stoves 403 to 406 is effected automatically by means of a program logical device 436 which receives signals defining the positions of the cut-off or discharge valves 407 to 410, 413 to 416, 421 to 424 and 445 to 448 and the throttling means 417 to 420 and 445 to 448 and also the signals of transducers 437 to 440 and 441 to 444 for measuring differences of pressure.

The transducers 437 to 440 measure the difference between the pressure in the cold blast manifold 402 and the pressure in each of the stoves 403 to 406. The transducers 441 to 444 measure the difference between the pressure in the auxiliary manifold 412 and the pressures in the stoves 403 to 406.

The control system of FIG. 4 operates in the following way. Assume that at the initial moment the stove 403 is at the end of its period of cooling (in other words, it is approaching the point $E_1$ in FIG. 3), and the stove 404 is at the end of its period of heating (in other words, it is approaching the point $A_3$, FIG. 3).

The time of the switching from the cooled stove 403 to the heated stove 404 can be determined, for example, by means of a time relay (not shown), connected to the device 436. This device 436 gives the command for closing the throttling means 446 (and also the corresponding valve, not shown on the drawing, installed on the pipe delivering the air for burning the fuel in the stove 404).

The cut-off valves 407 and 413 are closing simultaneously and the throttling means 418 is opening. As a result, the stove 403 is disconnected from the pipes of cold and hot blast and the stove 404 is connected to the manifold 412.

When the device 436 receives the signals that the cut-off valves 407 and 413 are fully closed, then the device 436 gives the command for opening the throttling means 417. The means 417 is opened according to a certain program providing for the necessary rate of letting the air from the stove 403 to the stove 404, with due regard to the conditions of strength and the transmissive capacity of manifold 412. When the difference between the pressures in the stove 403 and in the manifold 412 reach a predetermined magnitude (which should be only little different from 0) as measured by the transducer 441, the device 436 gives the command for closing the valve 418. When the device 436 receives the signal that said valve 418 is fully closed then the device 436 gives the signal for the simultaneous opening of the cut-off valve 433 and the throttling means 419. The throttling means 419 is opened according to a program which provides for an even delivery of the compressed air from the stove 403 to the stove 405.

Simultaneously with the opening of the throttling means 419, the device 436 gives the command for an additional opening by a certain given magnitude of the throttling means 447 in order to increase the delivery of fuel to be used for burning in stove 405, which is then in its period of heating.

The increased delivery of fuel during the period of letting the air from the stove 403 to stove 405 is necessary in order to keep the temperature of burning on an approximately constant level under conditions when the consumption of air to the stove 405 is increasing spasmodically.

The throttling means 433 being opened according to the given program, connects stove 404 with the intermediate accumulator 425. As a result, the pressure in the stove 404 begins to rise. When the difference between the pressure in the cold blast manifold and the pressure in the stove 404 reaches the predetermined magnitude (close to zero), as measured by the transducer 438, the device 436 gives the command for closing the throttling means 433.

When the device 436 receives the signal indicating that the means 433 is fully closed, then the device 436 gives the command for a simultaneous fast opening of the cut-off valves 408 and 414. As a result, the stove 404 is connected to both cold and hot blast manifolds 402 and 411.

When the difference between the pressure in the manifold 412 and the pressure in the stove 405 reaches the predetermined magnitude as measured by the transducer 443, then the device 436 gives the command for simultaneous closing of the throttling means 417 and 419. Simultaneously with the beginning of the closing of the throttling means 419, the device 436 gives a command to return the throttling means 447 to the initial position. When the device 436 receives the signal that throttling means 417 is fully closed, then the device 436 gives the command for beginning the heating of the stove 403.

When the pressure in the intermediate accumulator 425, measured by the transducer 452, drops below the predetermined level, the relay element 453 gives a signal to the subsystem 454 for starting the auxiliary compressor 426. The compressor 426 is then automatically stopped by means of this element 453 and subsystem 454, when the pressure in accumulator 425 reaches the predetermined magnitude.

The control system for the improved alternative operation of the stoves will be just the same as the above described system except that it will not include the elements for using the compressed air from a cooled stove for partial filling of a heated one.

It is evident from the above description that the improved method achieves its main purpose of eliminating the drop of air pressure during the periods of switching the stoves. And so with this improved method there is required approximately one half the air from an independent source in comparison with the air required in the conventional staggered parallel operation. This makes the use of the improved method both expedient and realistic. Specifically, the energy expenses for compressing the additional air and the volume required for the intermediate accumulator at the same pressure will be reduced by half.

In addition, the improved method reduces the expense of fuel needed for heating the stoves.

Furthermore, eliminating drops of pressure leads to two results: First, the stability of operation of the blast furnace increases which, in turn, increases the efficiency of the furnace, and improves the quality of the metal. Second, the amount of air blown into the furnace during a full stove cycle increases and consequently the output of the blast furnace increases.

According to the preliminary calculations the output of the furnace will increase from 0.5 to 1.5%, depending upon the volume and the frequency of the switching of the stoves.

Using the improved combined method will reduce sharply the time of filling of the stoves by compressed air because, in this case, this time does not depend upon the diameter of the pipes connecting the stoves together and to the intermediate accumulator.

If according to the conventional operation the time of filling is usually 4 to 6 minutes, then the improved combined method will reduce that time down to 1 to 1.5 minutes. It is evident that this reduction of filling time leads to a corresponding reduction of the thermal losses of the stove to the surrounding medium and consequently to a certain increasing of the temperature of the blast going to the blast furnace. In turn, the increasing of the temperature of the blast will provide for a corresponding reduction of the specific expense of coke in the furnace.

In the case of the improved alternative method of operating the stoves, letting the air from the cooled to the heated stove cannot be realized. Therefore, the heated stove should be filled by compressed air from the intermediate accumulator, and the whole excess air from the cooled stove, according to the improved method, should be directed to one of the stoves being in period of heating.

It should be mentioned, that the presence of an independent source of the compressed air is not necessary. Even without the independent source, according to this invention, using the compressed and heated air contained in the worked off stove increases considerably the efficiency of a group of the stoves and the blast furnace.

Obviously many modifications and variations of the present invention are possible in light of the above teachings. It is therefore to be understood that, within the scope of the appended claims, the invention may be practiced otherwise than as specifically described.

We claim:

1. The method of operating heating stoves which are heated successively or alternatively to then supply the hot blast required in a blast furnace by staggered parallel operation, the furnace being provided with a group of at least four stoves which group has a common cold air supply manifold connected to at least one turbo-blower, an auxiliary common cold air supply manifold connected to an air source independently of said at least one turbo-blower, an auxiliary common hot air manifold connecting all of the stoves only between themselves and a common hot blast manifold connected to said furnace, said method comprising:

disconnecting a first one of said stoves from both the cold and hot air common air manifolds; and equalizing the pressure in the second and said first stoves by connecting them both between themselves by use of the auxiliary common hot air manifold.

2. The method of claim 1 and further comprising:

filling up said second one of the stoves which is ready to go on-wind, to the pressure required, with compressed air from said independent source; and connecting the remaining hot air, having a pressure above atmospheric, of the first one of said stoves to a third one of said stoves being in a period of heating, for the purpose of aiding in the burning of the fuel in said third one of the stoves by connecting the first and third ones of the stoves by use of the auxiliary common hot air manifold.

* * * * *

UNITED STATES PATENT OFFICE
CERTIFICATE OF CORRECTION

Patent No. 3,951,586 Dated April 20, 1976

Inventor(s) Alexander Rutshtein et al

It is certified that error appears in the above-identified patent and that said Letters Patent are hereby corrected as shown below:

It is certified that errors appear in the above identified patent and that said Letters Patent is hereby corrected as shown below:

The following corrections are applicable to column 3: In lines 25 and 57, each occurrence, greek letters Tau should be changed to --t--. In lines 29, 31, 32, 35 and 37, "2" should read --3--. In line 30, "$A_2$" should read --$A_3$--. In line 34 "(point $M_2$)" should be cancelled. In line 37, "$B_2$" should read --$B_3$--. In lines 39 and 42, "3" should read --4--. In line 55, "$t_2$" should read --$2t_2$--. In line 55, "can" should read --will--. In lines 55 and 56, "or a little lower" should be cancelled.

Signed and Sealed this

First Day of March 1977

[SEAL]

*Attest:*

RUTH C. MASON
*Attesting Officer*

C. MARSHALL DANN
*Commissioner of Patents and Trademarks*